US010843324B2

(12) United States Patent
Bergquist et al.

(10) Patent No.: US 10,843,324 B2
(45) Date of Patent: Nov. 24, 2020

(54) VISIBLE MOTOR SAW HEAD LAYOUT

(71) Applicant: HUSQVARNA AB, Huskvarna (SE)

(72) Inventors: Oskar Bergquist, Huskvarna (SE); Johan Svennung, Vetlanda (SE)

(73) Assignee: HUSQVARNA AB, Huskvarna (SE)

( * ) Notice: Subject to any disclaimer, the term of this patent is extended or adjusted under 35 U.S.C. 154(b) by 469 days.

(21) Appl. No.: 15/561,691

(22) PCT Filed: Mar. 24, 2016

(86) PCT No.: PCT/EP2016/056619
§ 371 (c)(1),
(2) Date: Sep. 26, 2017

(87) PCT Pub. No.: WO2016/151100
PCT Pub. Date: Sep. 29, 2016

(65) Prior Publication Data

US 2018/0099398 A1 Apr. 12, 2018

(30) Foreign Application Priority Data

Mar. 26, 2015 (WO) ..... PCT/EP2015/056614

(51) Int. Cl.
*B25F 5/00* (2006.01)
*B25F 5/02* (2006.01)

(52) U.S. Cl.
CPC ..... *B25F 5/008* (2013.01); *B25F 5/02* (2013.01)

(58) Field of Classification Search
CPC ..... B25F 5/008
See application file for complete search history.

(56) References Cited

U.S. PATENT DOCUMENTS 5,377,632 A 1/1995 Aronsson et al.
5,960,549 A 10/1999 Höppner
(Continued)

FOREIGN PATENT DOCUMENTS

CN 101474787 A 7/2009
CN 203166678 A 8/2013
(Continued)

OTHER PUBLICATIONS

International Preliminary Report on Patentability for International Application No. PCT/EP2015/056614 dated Sep. 26, 2017, all enclosed pages cited.
(Continued)

*Primary Examiner* — Thienvu V Tran
*Assistant Examiner* — Bart Iliya
(74) *Attorney, Agent, or Firm* — Burr & Forman, LLP

(57) ABSTRACT

A housing assembly (26) for a working assembly (10) of an outdoor power device (20) may include a first, second, and third housing portion. The second and third housing portions may be operably coupled to the first housing portion to at least partially enclose a motor housing (60), which may comprise a body portion (62), a top endplate (64), and a bottom endplate (66) to house an electric motor for driving the working assembly (10). The first, second, and third housing portions may combine to define a first opening and a second opening (132, 134) such that two opposing sides of the body portion (62) are exposed in respective ones of the first and second openings (132, 134). In addition, or alternatively, a gap (130) may separate the housing assembly (26) from the entirety of the top endplate (64), the entirety of the body portion (62), and a substantial majority of the bottom endplate (66).

24 Claims, 6 Drawing Sheets

(56) References Cited

U.S. PATENT DOCUMENTS

| | | | | |
|---|---|---|---|---|
| 7,311,067 | B2 | 12/2007 | Riehmann | |
| 7,770,660 | B2 | 8/2010 | Schroeder et al. | |
| 9,027,198 | B2 * | 5/2015 | Conrad | A47L 9/16 15/344 |
| 9,220,201 | B2 * | 12/2015 | Kratzig | A01G 3/053 |
| 2003/0226264 | A1 | 12/2003 | Zemlok et al. | |
| 2010/0077985 | A1 * | 4/2010 | Osawa | B25F 5/02 123/198 E |
| 2010/0083513 | A1 | 4/2010 | Pellenc | |
| 2010/0218385 | A1 | 9/2010 | Mang et al. | |
| 2011/0001368 | A1 | 1/2011 | Lau | |
| 2014/0008092 | A1 * | 1/2014 | Yanagihara | B25F 5/00 173/213 |
| 2015/0013172 | A1 | 1/2015 | Shaffer | |
| 2015/0047604 | A1 | 2/2015 | Isono et al. | |
| 2016/0059402 | A1 * | 3/2016 | Notaras | B25F 5/006 74/491 |
| 2016/0067841 | A1 * | 3/2016 | Schwaiger | B23B 39/10 408/128 |
| 2016/0271783 | A1 | 9/2016 | Pickett et al. | |

FOREIGN PATENT DOCUMENTS

| | | | |
|---|---|---|---|
| CN | 101941200 | B | 3/2015 |
| CN | 104416549 | A | 3/2015 |
| DE | 202010014781 | U1 | 12/2010 |
| EP | 2223777 | A2 | 9/2010 |
| EP | 2845691 | A1 | 3/2015 |
| WO | 2007069946 | A1 | 6/2007 |
| WO | 2013032372 | A1 | 3/2013 |
| WO | 2013187837 | A2 | 12/2013 |

OTHER PUBLICATIONS

International Search Report and Written Opinion for International Application No. PCT/EP2015/056614 dated Dec. 9, 2015.
International Search Report and Written Opinion for International Application No. PCT/EP2016/056619 dated May 27, 2016.
International Preliminary Report on Patentability for International Application No. PCT/EP2016/056619 dated Feb. 28, 2017.

* cited by examiner

VISIBLE MOTOR SAW HEAD LAYOUT

TECHNICAL FIELD

Example embodiments generally relate to an outdoor power device that is electrically powered and, more particularly, relate to a cutting device with a cutting head that has an open housing, such that the motor is exposed and visible.

BACKGROUND

Handheld outdoor power devices such as trimmers, blowers, chainsaws, and/or the like, are often used to perform tasks relating to yard/grounds maintenance or even commercial resource harvesting activities that require them to be mobile. Such devices often have a working implement adjacent to, or extending from, a battery powered electric motor. In designing these devices, it is important that the devices remain lightweight to ensure comfortable and ergonomic operation. In addition, it is important the motor be properly cooled, so that the motor does not overheat during operation, resulting in damage to itself, other device components, or the device housing.

In actively cooled devices, a fan or other means for forcing air is incorporated into the device on or near the motor head. In this manner, the fan forces ambient air past the motor to enhance cooling. However, while effective, active cooling results in additional weight due to the fan, its support structure, and its control electronics. In this regard, the additional size and weight may make the device too heavy.

Passive cooling eliminates the need for including a cooling fan in the cutting head and thus reduces the size and weight of the device significantly. However, to be effective, passive cooling systems must be carefully designed to ensure sufficient cooling air flow rate. In addition, it is desirable to design passive cooling systems in a manner that keeps the overall weight of the device as light as possible.

To improve upon this situation, it is desirable to design outdoor power devices in a manner that is small, lightweight, ergonomic, and provides sufficient cooling capacity for the motor.

BRIEF SUMMARY OF SOME EXAMPLES

Some example embodiments may therefore provide an outdoor power device with a working assembly that comprises a motor housing that is exposed and visible. In this regard, the housing of the working assembly may comprise a chassis base, an oil reservoir, and a housing arm which combine to partially enclose a motor housing, thereby defining two openings through which the motor housing is directly exposed to cooling air on two opposing sides. In addition, some embodiments provide a motor housing that only contacts the working assembly housing where it is attached by support towers. A gap may exist around substantially the entire motor housing, resulting in improved passive cooling and reduced need for active cooling systems. Accordingly, some embodiments may provide a low profile, lightweight, and passively cooled motor housing for an outdoor power device. An operator of the device may therefore experience less fatigue and improved visibility of the working implement, while the motor experiences improved cooling capacity without the need for an active cooling system.

In accordance with an example embodiment, a housing assembly for a working assembly of an outdoor power device is provided. The housing assembly may include a first, second, and third housing portion, wherein the second and third housing portions may be operably coupled to the first housing portion to at least partially enclose a motor housing. The motor housing may comprise a body portion, a top endplate, and a bottom endplate to house an electric motor for driving the working assembly. The first, second, and third housing portions may combine to define a first opening and a second opening such that two opposing sides of the body portion are exposed in respective ones of the first and second openings.

A working assembly of an outdoor power device may comprise an electric motor for driving the working assembly, the motor being housed in a motor housing comprising a body portion; a bottom endplate; and a top endplate. The working assembly may further comprise a housing assembly comprising a plurality of housing portions enclosing the motor housing in a space defined by said plurality of housing portions, wherein the plurality of housing portions combine to define a first opening and a second opening such that two opposing sides of the body portion of the motor housing are exposed in respective ones of said first and second openings. Said plurality of housing portions may comprise a first housing portion; a second housing portion operably coupled to the first housing portion; and a third housing portion operably coupled to the first housing portion to define said space, wherein said first, second, and third housing portions combine to define said first opening and said second opening.

A number of embodiments of the housing assembly and the working assembly hereinabove are conceived. By way of example, said exposed, opposing sides of the body portion may be unobscured by any gratings or louvers, so as to allow an unobstructed passive cooling flow of ambient air past said exposed, opposing sides of the body portion. A respective total area of each of said first and second openings may be more than 5%; preferably more than 10%; and even more preferred, more than 15% of a total outer surface area of the motor housing, to allow a substantial passive cooling. Said exposed, opposing sides of the body portion of the motor housing may protrude out of said space defined by said plurality of housing portions, to even further increase heat exchange with the ambient air. The motor housing may have a substantially cylindrical, and preferably, substantially circular-cylindrical shape, the mantle of the cylindrical shape defining said body portion.

The first housing portion may comprise a chassis base that is configured to receive the motor housing such that the bottom endplate is proximate to and covered by the chassis base, but such that a majority of the bottom endplate is not in contact with the chassis base. The bottom endplate of the motor housing may comprise a plurality of support towers for rigidly fixing the motor housing to the chassis base. An insulating gasket may be interposed between the one or more support towers and the chassis base.

The second housing portion may comprise an oil reservoir that covers a portion of the body portion without contacting the motor housing.

The third housing portion may comprise a housing arm that extends over the motor housing such that the housing arm covers at least a portion of both the top endplate and the body portion without contacting either the top endplate or the body portion. The housing arm may extend from the first housing portion to the second housing portion such that it defines the first opening and the second opening, and wherein a portion of the top endplate is exposed in each of the first and second openings. The housing arm may be configured to receive electrical wiring.

A gap may separate the housing assembly from the entirety of the top endplate, the entirety of the body portion, and a substantial majority of the bottom endplate. The gap between the motor housing and the first, second, and third housing portions may be approximately 1-3 mm.

The body portion may comprise a plurality of radially extending cooling fins. The first housing portion may be proximate to and cover the bottom endplate. The second housing portion may be proximate to and cover a portion of the body portion. The third housing portion may comprise a housing arm proximate to and covering a portion of the body portion and the top endplate. The two opposing sides of the body portion that are exposed in respective ones of the first and second openings may be formed on either side of the housing arm. An entire height of the body portion, and preferably a portion of the top endplate, may be exposed in respective ones of the first and second openings to allow for a substantial exposure of the motor housing to ambient air.

A working assembly of an outdoor power device may, according to an exemplary embodiment, comprise a motor housing comprising a cylindrical body portion, a top endplate, and a bottom endplate; and a housing assembly comprising a chassis base, an oil reservoir, and a chassis arm, wherein the bottom endplate of the motor housing is attached to the chassis base such that chassis base covers only the bottom endplate, wherein the oil reservoir is connected to the chassis base such that it covers only a first portion of the cylindrical body portion, wherein the chassis arm extends over the motor housing from the oil reservoir to the chassis base such that it only covers a portion of the top endplate and a second portion of the cylindrical body portion, and wherein the first portion and the second portion of the cylindrical body portion are on opposite sides of the motor housing.

The bottom endplate of the motor housing may comprise a plurality of support towers for rigidly fixing the motor housing to the chassis base, the support towers defining a contacting portion of the bottom endplate. A gap may separate the housing assembly from the entirety of the top endplate, the entirety of the body portion, and all but the contacting portion of the bottom endplate. The gap between the motor housing and the housing assembly may be approximately 1-3 mm. An insulating gasket may be interposed between the plurality of support towers and the chassis base. The chassis arm may extend from the chassis base to the oil reservoir such that it defines the first opening and the second opening, and wherein portions of the cylindrical body and the top endplate are exposed in each of the first and second openings. The chassis arm may be configured to receive electrical wiring.

An outdoor power device may comprise a power assembly comprising an electric power source; a working assembly according to any of the embodiments described hereinabove; and a control assembly for selectively providing power from the power assembly to the electric motor of the working assembly.

According to an exemplary embodiment, an outdoor power device may comprise a working assembly comprising a housing assembly and an electric motor disposed in a motor housing, the motor housing comprising a body portion, a top endplate, and a bottom endplate; a power assembly comprising an electric power source; and a control assembly for selectively providing power from the power assembly to the working assembly via the electric motor; and wherein the housing assembly comprises a first housing portion that is operably coupled with a second housing portion and a third housing portion to at least partially enclose the motor housing such that two opposing sides of the motor housing are exposed, and wherein the first, second, and third housing portions combine to define a first opening and a second opening such that two opposing sides of the body portion are exposed in respective ones of the first and second openings.

The outdoor power device according to any of the embodiments described hereinabove may further comprise a front handle and a rear handle, wherein said front and rear handles are different from the housing assembly. Said housing portions and said front and rear handles may be separate components. Said power assembly and said working assembly may be attached to opposite ends of a pole. The outdoor power device may be an electrically powered gardening or forestry tool, such as a vegetation cutting tool. The first housing portion may comprise a chassis base that is configured to receive the motor housing such that the bottom endplate is proximate to and covered by the chassis base, but such that a majority of the bottom endplate is not in contact with the chassis base. The bottom endplate of the motor housing may comprise a plurality of support towers for rigidly fixing the motor housing to the chassis base. An insulating gasket may be interposed between the one or more support towers and the chassis base.

The second housing portion may comprise an oil reservoir that covers a portion of the body portion without contacting the motor housing. The third housing portion may comprise a housing arm that extends over the motor housing such that it covers at least a portion of both the top endplate and the body portion without contacting either the top endplate or body portion. The housing arm may extend from the first housing portion to the second housing portion such that it defines the first opening and the second opening, and wherein a portion of the top endplate is exposed in each of the first and second openings. The housing arm may be configured to receive electrical wiring. A gap may separate the housing assembly from the entirety of the top endplate, the entirety of the body portion, and a substantial majority of the bottom endplate. The gap between the motor housing and the first, second, and third housing portions may be approximately 1-3 mm.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION

Figure 1:
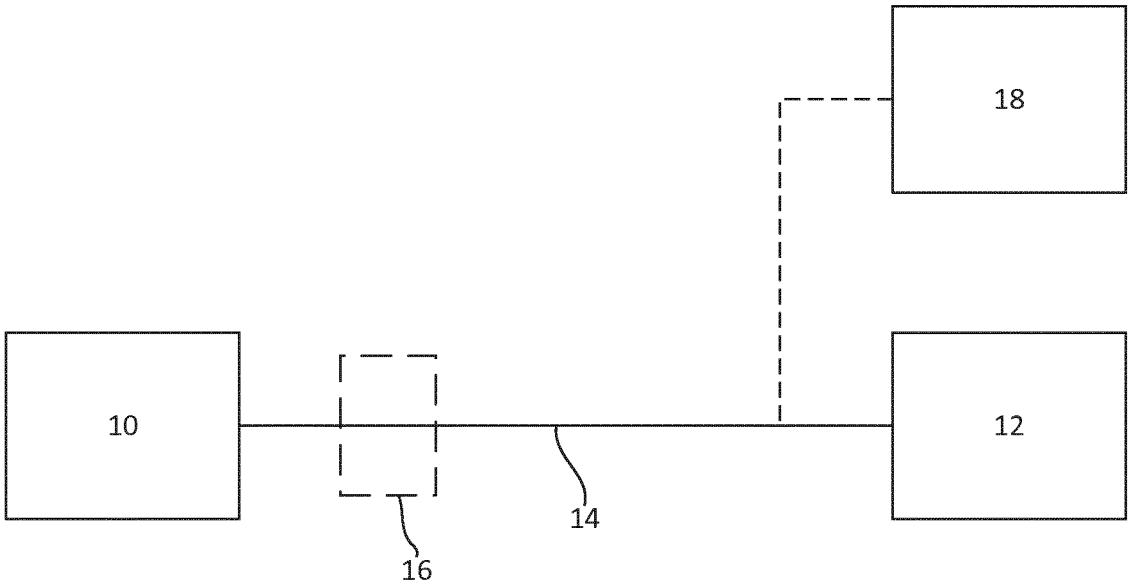
FIG. 1 illustrates a functional block diagram of a device configured in accordance with an example embodiment.

Some example embodiments now will be described more fully hereinafter with reference to the accompanying drawings, in which some, but not all example embodiments are shown. Indeed, the examples described and pictured herein should not be construed as being limiting as to the scope, applicability or configuration of the present disclosure. Rather, these example embodiments are provided so that this disclosure will satisfy applicable legal requirements. Like reference numerals refer to like elements throughout. Furthermore, as used herein, the term "or" is to be interpreted as a logical operator that results in true whenever one or more of its operands are true. As used herein, operable coupling should be understood to relate to direct or indirect connection that, in either case, enables functional interconnection of components that are operably coupled to each other.

Some example embodiments described herein provide an outdoor power device with a partially exposed and visible motor, thus providing a low profile, lightweight construction that provides improved cooling capacity. In this regard, some embodiments may employ a work assembly (e.g., a cutting head) that has a housing comprising a chassis base, an oil reservoir, and a housing arm which combine to partially enclose a motor housing. In this manner opposing sides of the motor housing are exposed to the ambient cooling air for improved cooling. In addition to improving the passive cooling of the motor, such a construction decreases the size of the working assembly, thus providing improved working visibility. The construction is also lightweight, such that operator comfort and device maneuverability is improved.

Referring to the drawings, FIG. 1 shows a functional block diagram of a device configured in accordance with an example embodiment. The device may include a working implement or working assembly 10 that is operably coupled to a power assembly 12. The power assembly 12 may have an elongated member, such as a pole 14 extending therefrom, which is operably connected to the working assembly 10 through an orientation adjustment assembly 16. The power assembly 12 may further comprise an electric power source, such as a battery pack, for powering an electric motor, which may be a part of the working assembly 10. The battery pack may be electrically connected to the electric motor by electrical wires which are passed from the power assembly 12 through the center of the hollow pole 14 to the working assembly 10. A control assembly 18 controls the amount of electric power delivered from the power assembly 12 to the working assembly 10. An orientation adjustment assembly 16 provides a means for connecting the pole 14 extending from the power assembly 12 with the working assembly 10, such that the working assembly 10 may pivot relative to the pole 14 to provide multiple ergonomic modes of operation.

Figure 2:
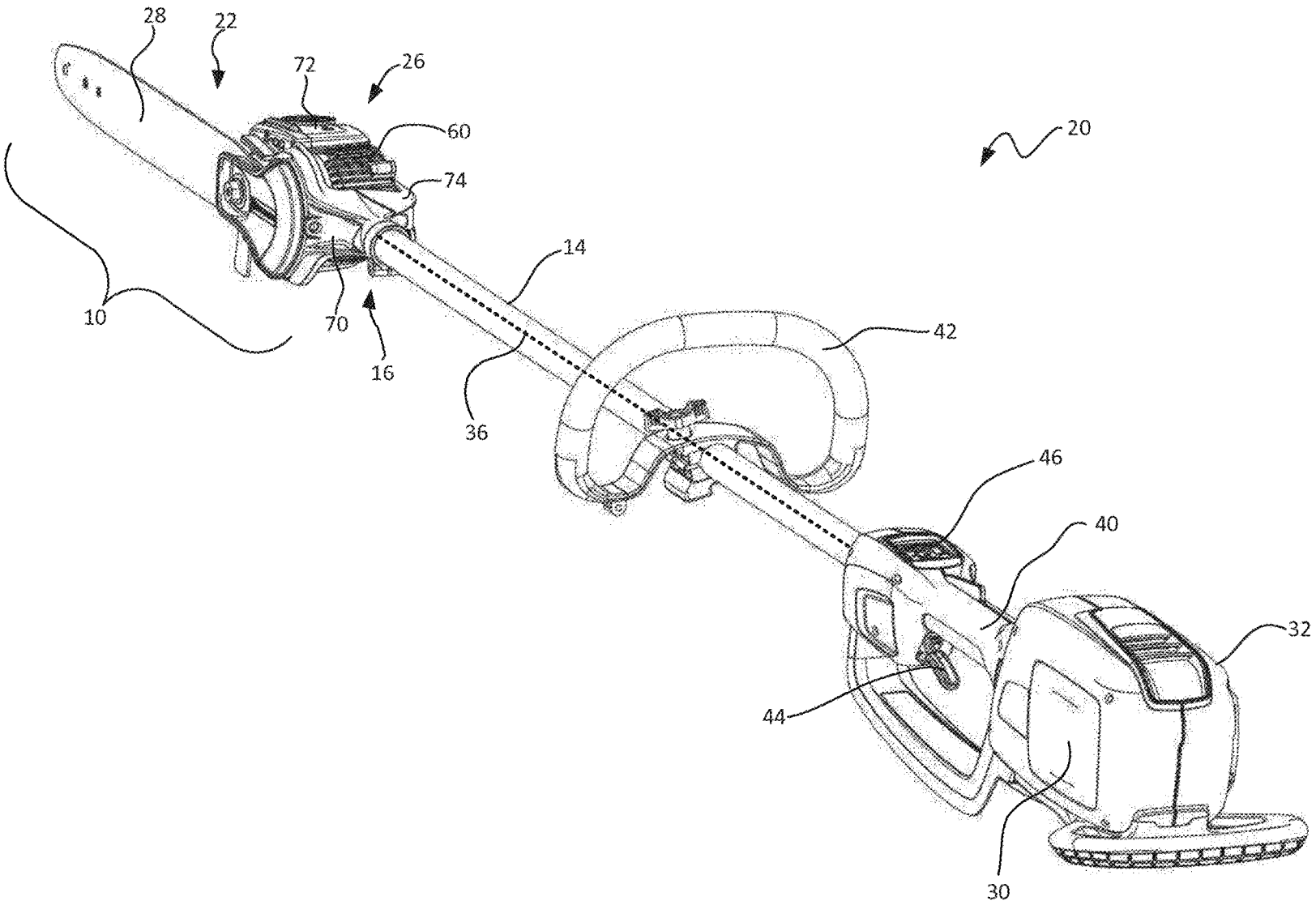
FIG. 2 illustrates a perspective view of a battery powered polesaw that may be configured in accordance with an example embodiment.

FIG. 2 shows an electrically powered polesaw 20 that may be configured in accordance with an example embodiment. However, it should be appreciated that the polesaw 20 is merely one example of an electrically powered, outdoor power device that may be configured in accordance with an example embodiment. Thus, for example, some embodiments may be practiced in connection with other outdoor power devices such as edgers, brush cutters, and/or the like. It should also be appreciated that the polesaw 20 of FIG. 2 is a battery powered device. However, example embodiments could alternatively be employed in connection with corded versions of various electrically powered, outdoor power devices. Moreover, in some cases, example embodiments could also be practiced in connection with combustion engines that are configured to enable conversion of the direction that the output shaft turns. Thus, although an example embodiment will be described hereinafter with specific reference to the battery powered polesaw 20 of FIG. 2, the applicability of alternative embodiments relative to other types of devices should be well understood.

As shown in FIG. 2, the polesaw 20 may include a working implement or working assembly 10, which in this example includes a rotatable cutting blade assembly 22. The working assembly 10 may further include a motor, such as electric motor disposed in a housing 26 of the working assembly 10. The motor may be used to power a cutting chain (not shown) which is disposed on the guide bar 28 for the effective cutting of any branches or vegetation. In this regard, in the example embodiment of FIG. 2, the motor turns a drive shaft and a sprocket drive wheel (not shown). The cutting chain is operably coupled to the sprocket drive wheel and is supported in a peripheral groove which extends around the guide bar 28. The guide bar 28 is attached to the housing 26 by a tensioning and clamping assembly (not shown) provided at the proximal end of the guide bar 28.

The motor of the polesaw 20 may be powered, according to this example, by a battery pack 30. The battery pack 30 is received in a battery compartment of the polesaw 20. In an example embodiment, the battery compartment may be a recess or cavity formed in a casing 32 of the power assembly 12. The battery compartment can be located in the top, bottom, or sides of the casing 32. The casing 32 may substantially enclose the battery compartment, control circuitry, and/or other components associated with powering and/or controlling the operation of the polesaw 20. In some embodiments, the casing 32 may be formed from one or more plastic or other rigid components that may be molded to have a desired shape. For example, in some cases, the casing 32 may be composed of a right half portion and a left half portion that may form a majority of the casing 32.

In an example embodiment, an elongated member, such as pole 14 operably couples the working assembly 10 to the power assembly 12, which are disposed at opposite ends of the pole 14. Although depicted as a pole 14 in the example embodiment, the elongated member may be a hollow tube, pipe, rod, or other such member that may be straight or curved in different embodiments. The elongated member may also provide operable communication between the working assembly 10 and the battery pack 30 such that the battery pack 30 can power the working assembly 10. In this regard, wires (indicated by dotted line 36 in FIG. 2) extend from the battery pack 30 through the pole 14 to the working assembly 10 to provide power to the motor. However, it should be appreciated that alternative means for electrically connecting the motor and power source are also contemplated. It should also be appreciated that the battery pack of some alternative embodiments may be housed within a backpack that may be worn on the operator's back. In such an example, the battery pack may be connected to the polesaw 20 via a cord or other adaptor.

The polesaw 20 may include a rear handle 40 and a front handle 42. The rear handle 40 may be disposed in-line with the pole 14 proximate to the casing 32, while the front handle 42 may be disposed between the casing 32 and the working assembly 10 along the pole 14. An operator of the polesaw 20 may use one hand to hold the front handle 42 and the other hand to hold the rear handle 40 while operating the polesaw 20. In some embodiments, the rear handle 42 may include a trigger 44 or other control mechanism for engaging operation of the motor to power the working assembly 10. Although FIG. 2 shows the front handle 42 being positioned forward of the rear handle 40 along the pole 14, it should also be appreciated that other arrangements for holding and operating the polesaw 20 may be provided. For example, in some cases, a "handlebar" embodiment may be provided in which the front and rear handles 42/40 are replaced by a single handle assembly attached to the pole 14, where both handles on the handle assembly are substantially equidistant from the working assembly 10 and disposed spaced apart from the pole 14 on opposites sides thereof on a handlebar assembly. In addition, the front handle 42 may be fully adjustable, and may be rotated about the pole 14 or moved axially with respect to the pole. After being adjusted to the desired position and orientation, the front handle 42 may be fixed by a screw clamp, set screw, or any other suitable securing means. Other arrangements are also possible.

Figure 3:
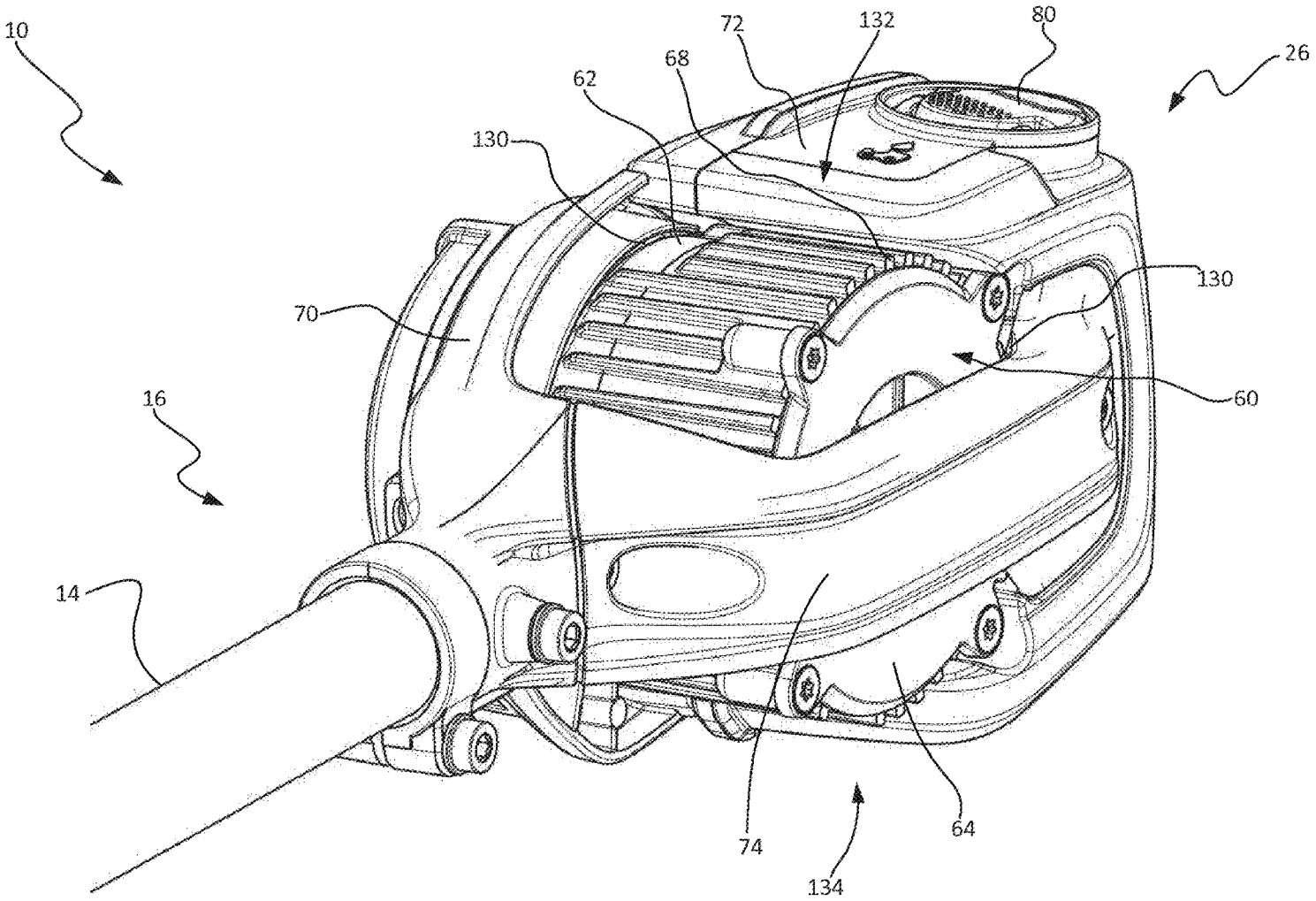
FIG. 3 illustrates a close-up perspective view of a work assembly of the polesaw according to an example embodiment.
Figure 4:
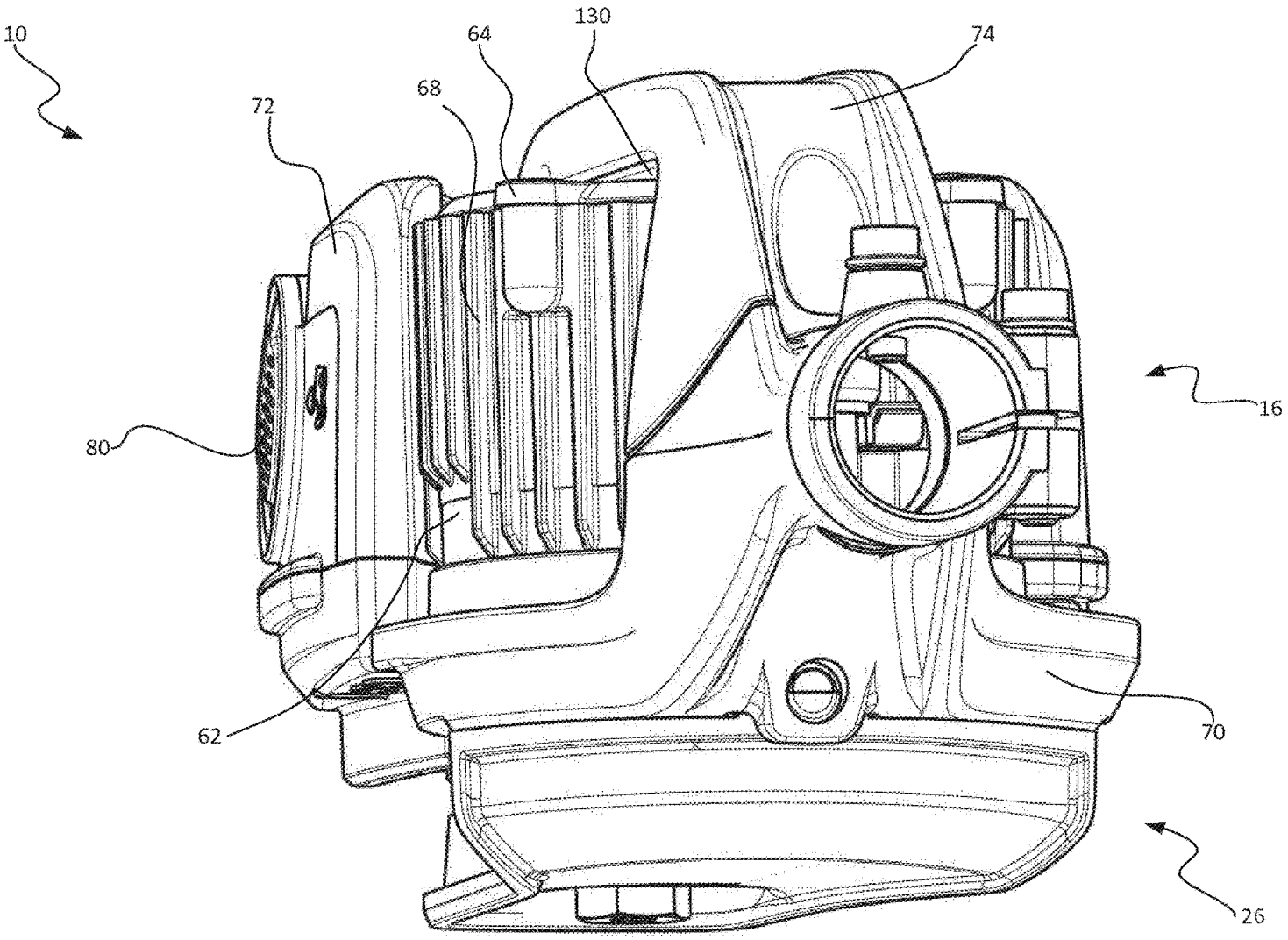
FIG. 4 illustrates a close-up perspective view of a work assembly of the polesaw according to an example embodiment.
Figure 5:
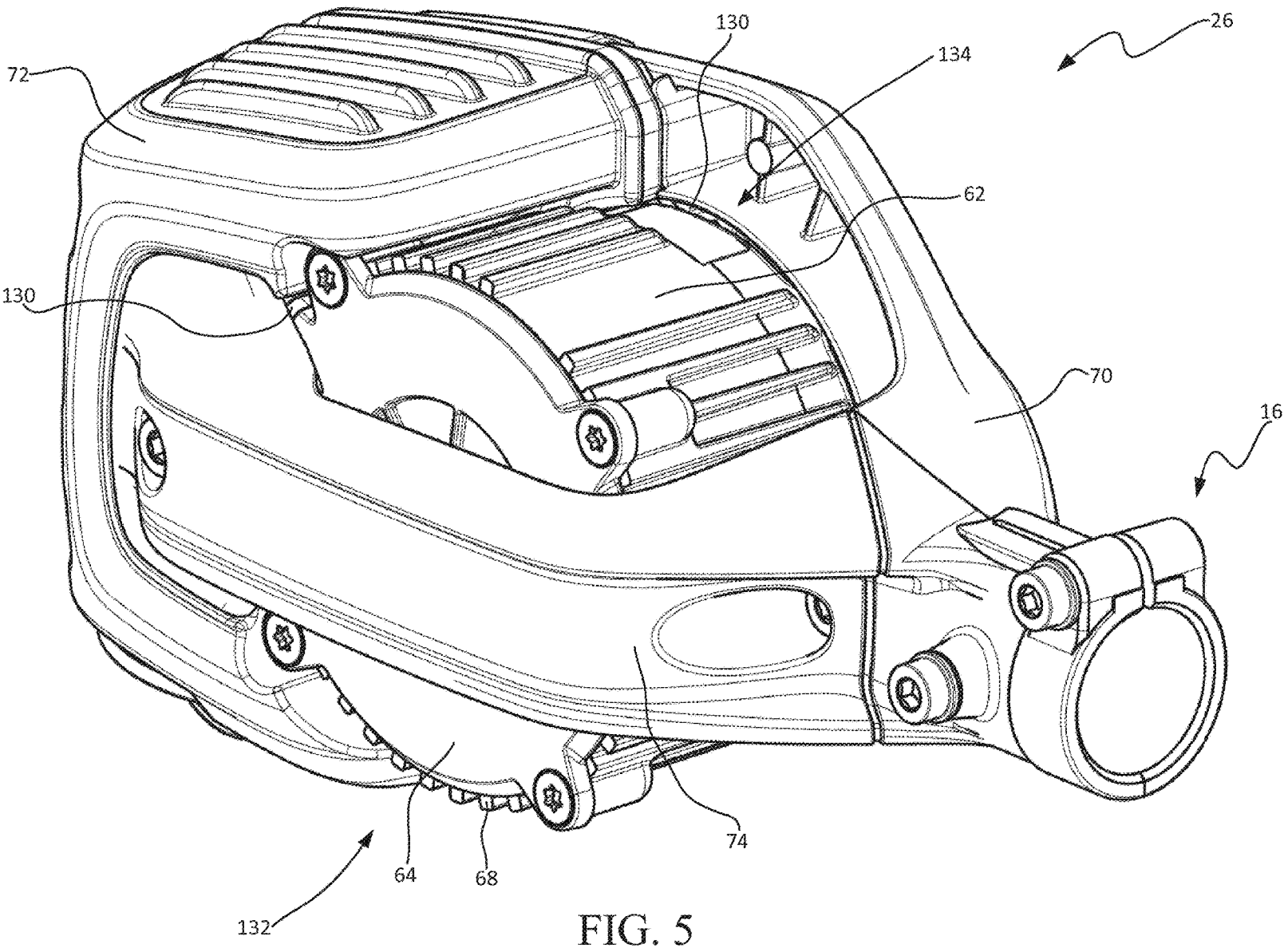
FIG. 5 illustrates a close-up perspective view of a work assembly of the polesaw according to an example embodiment.

In an example embodiment, the motor may be a DC motor or a brushless DC motor (BLDC) that is powered by the battery pack 30. The power assembly 12 and battery pack 30 may be controlled by the trigger 44 and/or the control panel 46. In the example embodiments shown in FIG. 2, the trigger 44 and control panel 46 are positioned on the casing 32 of the power assembly 12 proximate to the rear handle 40. However, the trigger 44 and control panel 46 could be positioned at any of a number of other locations on the polesaw 20 in alternative embodiments, such as on front handle 42. The control panel 46 may be configured to control numerous aspects of the operation of the polesaw 20. For example, the control panel 46 may monitor motor speed, set speed limits, apply cruise control, etc FIGS. 3-5 illustrate several close-up perspective views of a working assembly 10 of the polesaw 20 according to an example embodiment to more clearly illustrate some of the features of the working assembly 10. As is illustrated in the figures, the working assembly 10 may comprise an electric motor in a self-contained motor housing 60. The motor housing 60 comprises a cylindrical portion 62 capped on both ends by endplates (top endplate 64 is visible in FIG. 3 and bottom endplate 66 is visible in FIG. 6). In addition, the cylindrical portion 62 of the motor housing 60 may include a plurality of radially extending cooling fins 68 around its periphery to improve cooling efficiency. In alternative embodiments, cooling fins may also be located on the endplates of the motor housing 60. Each endplate may be screwed or otherwise fastened onto the cylindrical portion 62 to form a self-contained and sealed environment for the motor. In some embodiments, the bottom endplate 66 is not a separate part, but is instead integrally formed with the cylindrical portion 62. While the illustrated motor housing 60 is cylindrical, one skilled in the art will appreciate that it is possible to use many other motor shapes and remain within the scope of the invention. For example, the motor housing may be square, non-symmetrical, or any other shape sufficient to house the electric motor. All such embodiments are contemplated as within the scope of the inventions.

Example embodiments are directed to a motor housing 60 that forms a part of the working assembly 10 and is exposed to the environment. Therefore, the motor housing 60 must be sufficiently rugged and durable to withstand potentially harsh environmental exposure or working conditions. For example, the motor housing 60 should be rust resistant and capable of withstanding direct impacts which may be more likely to occur because the motor is exposed. Therefore, the motor housing 60 is preferably constructed of aluminum, a light metal/alloy, or any other sufficiently rigid and durable material capable of housing the electric motor. In addition, the motor housing 60 may be treated with an anti-rust coating to inhibit the formation of rust and increase durability.

The working assembly 10 may further comprise a housing 26 that at least partially encloses motor housing 60. In some embodiments, the housing 26 may comprise a first, second, and third housing portion. For example, in the illustrated embodiment, the first, second, and third housing portions are a chassis base 70, an oil reservoir 72, and a housing arm 74, respectively. Although the remainder of this description refers to these three components as making up the housing 26, one skilled in the art will appreciate that each portion may include a variety of additional functional components or parts, and that additional housing portions may also be used. In addition, in some cases the housing arm 74 may be removed.

The chassis base 70 may serve as a base of the working assembly 10. In this regard, the pole 14 may be connected to the chassis base 70 through the orientation adjustment assembly 16. The motor housing 60 may also be fixed to the chassis base 70 such that the motor shaft extends through an aperture 76 (see FIG. 6) in the chassis base 70 and is operably coupled to the cutting chain through the rotatable cutting blade assembly 22.

Figure 6:
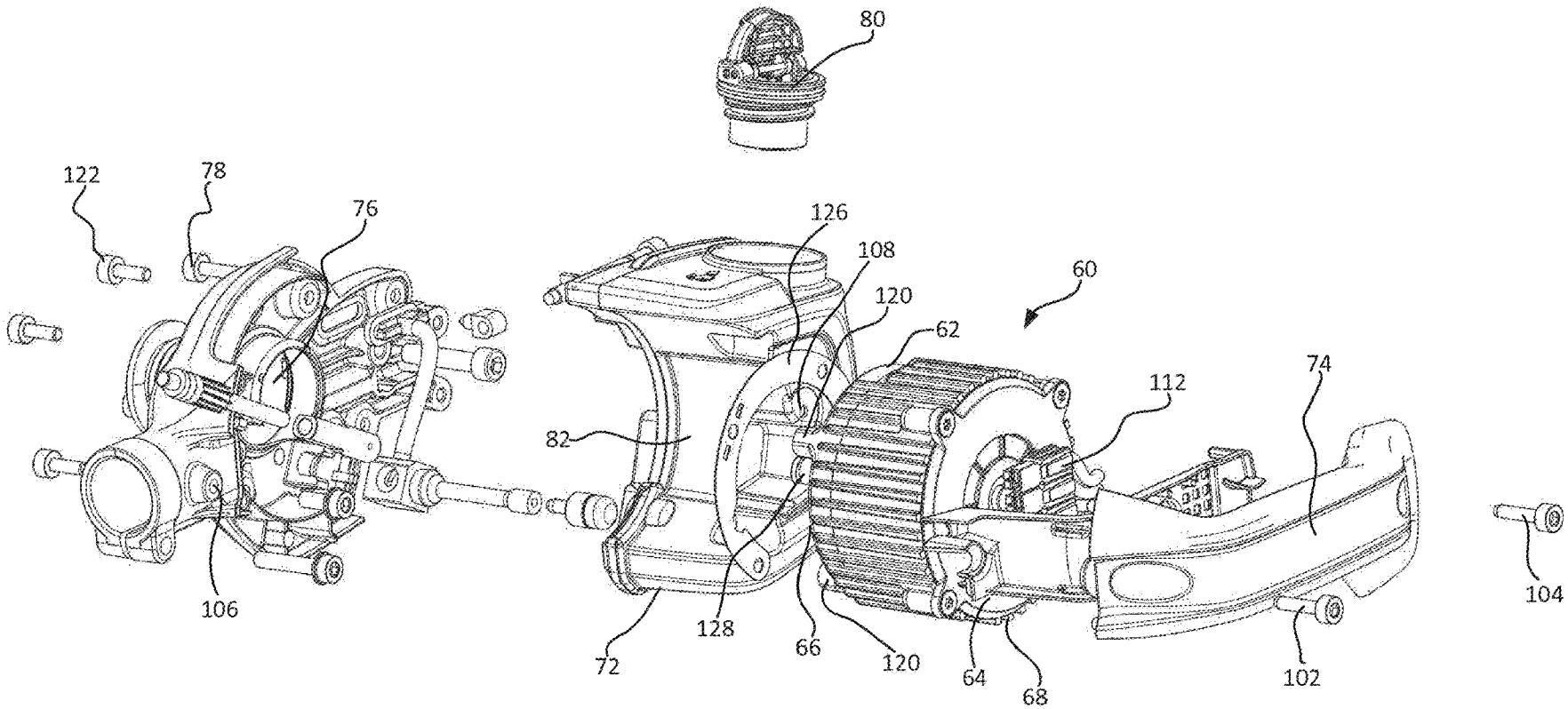
FIG. 6 illustrates an exploded view of work assembly of the polesaw according to an example embodiment.

The oil reservoir 72 may be disposed at the distal end of the working assembly 10 proximate to the cutting blade 28, and may be secured to the chassis base 70 by one or more fasteners (e.g., fastening screw 78 in FIG. 6). The oil reservoir cap 80 is provided for filling the oil reservoir 72 with lubricating oil for lubricating the cutting chain. As shown in FIG. 6, the oil reservoir 72 may be shaped with a curved surface 82 for conforming to the contour of the cylindrical portion 62 of the motor housing 60.

In the example embodiment of FIGS. 3-5, the housing arm 74 may connect to the oil reservoir 72 and the chassis base 70, such that the housing arm 74 extends over the top endplate 64 and the cylindrical portion 62 of the motor housing 60 such that the motor housing 60 is only partly covered. Housing arm mounting screws 102 and 104 can be received by the threaded bores 106 and 108, respectively, to secure the housing arm 74 to the chassis base 70 and oil reservoir 72. In the illustrated embodiment of FIG. 6, the housing arm 74 may be a two-piece construction that may be, for example, snapped together or secured in place by mounting screws 102 and 104. The housing arm 74 may be further configured to receive electrical wiring 112 and/or a motherboard for the electric motor. In an alternative embodiment, the housing arm 74 may be a single-piece construction. One skilled in the art will appreciate that the size, shape, and material of the housing arm 74 could be changed to meet the needs of a particular application. For example, the housing arm might be a thin bar intended to decrease weight a improve the profile of the working assembly. By contrast, the housing arm might be a bulky, wide piece of rigid plastic intended to provide more impact protection for the motor housing.

In the illustrated embodiment of FIGS. 3-5, the housing 26 is constructed so that the chassis base 70 is proximate only to the bottom endplate 66, and does not cover any part of the cylindrical portion 62 or the top endplate 64. Similarly, the oil reservoir 72 is constructed such that it connects to the chassis base 70, but only covers the cylindrical portion 62 of the motor housing 60. The housing arm 74 extends from the oil reservoir 72 around the motor housing 60 to the chassis base 70, thereby covering two sides of the motor housing 60—i.e., the top endplate 64 and the cylindrical portion 62.

FIG. 6 illustrates an exploded view of work assembly 10 of the polesaw 20 according to an example embodiment. The chassis base 70 has a receiving neck 16 for receiving the pole 14 and is configured to receive the motor housing 60. The motor housing 60 may comprise one or more structural supports that receive motor housing fasteners to secure the motor housing 60 to the chassis base 70. For example, the motor housing 60 may have four support towers 120 that are cylindrical bosses with internal threaded bores that are configured to receive motor mounting screws 122. In this manner, the motor mounting screws 122 may secure the motor housing 60 to the chassis base 70 while the support towers 120 provide clearance over substantially the entire portion of the bottom endplate 66 of the motor housing 60.

In order to insulate the motor housing 60 from the chassis base 70, a gasket 126 may be interposed between the support towers 120 of the motor housing 60 and the chassis base 70. The gasket may be paper, rubber, or any other insulating material suitable for minimizing heat transfer between the motor housing 60 and the chassis base 70. In an example embodiment, once the working assembly 10 has been assembled, the only portions of the motor housing 60 that are in contact with other components are the ends of the support towers 120 and the drive shaft 128.

Once assembled, the motor housing 60 is disposed within the housing 26. The chassis base 70, oil reservoir 72, and housing arm 74 may define two large openings in the housing 26—one on either side of the housing arm 74 (e.g., first opening 132 and second opening 134 as shown in FIG. 3). In this manner, two large portions of the motor housing 60 are not covered by the housing 26 and are visible and exposed to the environment. For example, in the illustrated embodiment, the entire height of the cylindrical portion 62 of the motor housing 60 is exposed on opposing sides. In addition, a majority of the periphery of the cylindrical portion 62 is exposed.

In addition, the housing arm 74 may extend over the top endplate 64 in a manner that essentially splits its surface area in two, thus exposing at least a portion of the top endplate 64 on either side of the housing arm 74. The top endplate 64 of the motor housing 60 may thereby be largely exposed, because the narrow housing arm 74 only covers a small portion of the surface area of the top endplate 64. As a result, the motor housing 60 experiences enhanced cooling because it is exposed to the environment. In this manner, it may transfer heat away from the motor and to the environment without having to go through or around a portion of the housing or other obstructions, such as louvers, for example.

In addition to having exposed surfaces, the motor housing 60 may be disposed within the housing 26 such that there is a clearance gap 130 between nearly the entire outer surface of the motor housing 60 and the housing 26. In this regard, as is shown in the example embodiment, air may circulate about the entire cylindrical periphery 62, top endplate 64, and bottom endplate 66 of the motor housing. This circulation is achieved by virtue of the fact that the only place that the motor housing 60 is in contact with the housing 26 is where it is attached to the chassis base 70 through the support towers 120.

Therefore, the motor housing 60 is supported in the housing 26 such that there is a small gap 130 around substantially the entire motor housing 60 and all sides are open to circulating cooling air. For example, the radial edge at the bottom of the motor housing has a gap 130 between the motor housing 60 and the chassis base 70 to permit air to flow underneath the motor housing 60 (see FIG. 3). Similarly, a gap 130 is present between the motor housing 60 and the oil reservoir 72 (see FIG. 3) and the housing arm 74 (see FIG. 4). In an example embodiment, the gap 130 is approximately 1-3 mm wide and extends around the entire motor housing 60, except where the support towers 120 secure the motor housing 60 to the chassis base 70. However, the gap size may vary depending on the needs of a specific application. In addition, the gap size may be constant or vary depending on which portions of the surface area of the motor housing 60 need more cooling capacity. By having a working assembly housing 26 that is partially open, the motor housing 60 that is disposed therein may experience enhanced cooling.

The first, second, and third housing portions of the housing 26 may be constructed with any material or materials sufficient to support the motor housing 60 while achieving their respective functions. For example, in order to maintain a lightweight frame, rigid plastic may be used to construct each portion. Alternatively, a light metal or light alloy, such as aluminum may also be used in some embodiments. In addition, one skilled in the art will appreciate that the size and shape of the first, second, and third housing portions can be changed as needed to meet the needs of a particular application.

In accordance with an example embodiment, a housing assembly for a working assembly of an outdoor power device is provided. The housing assembly may include a first, second, and third housing portion, wherein the second and third housing portions may be operably coupled to the first housing portion to at least partially enclose a motor housing. The motor housing may comprise a body portion, a top endplate, and a bottom endplate to house an electric motor for driving the working assembly. The first, second, and third housing portions may combine to define a first opening and a second opening such that two opposing sides of the body portion are exposed in respective ones of the first and second openings.

The device of some embodiments may include additional features that may be optionally added. For example, in an example embodiment, the first housing portion may comprise a chassis base that is configured to receive the motor housing such that the bottom endplate is proximate to and covered by the chassis base, but such that a majority of the bottom endplate is not in contact with the chassis base. In some embodiments, the bottom endplate of the motor housing comprises a plurality of support towers for rigidly fixing the motor housing to the chassis base. In some cases, an insulating gasket is interposed between the one or more support towers and the chassis base. However, the gasket is not required.

According to some example embodiments, the second housing portion may comprise an oil reservoir that covers a portion of the body portion without contacting the motor housing. In some embodiments, the third housing portion may comprise a housing arm that extends over the motor housing such that it covers at least a portion of both the top endplate and the body portion without contacting either the top endplate or body portion. In a still further embodiment, the housing arm may extend from the first housing portion to the third housing portion such that it defines the first opening and the second opening, and wherein a portion of the top endplate is exposed in each of the first and second openings. Additionally or alternatively, a gap may separate the housing assembly from the entirety of the top endplate, the entirety of the body portion, and a substantial majority of the bottom endplate. The gap between the motor housing and the first, second, and third housing portions may be, for example, approximately 1 mm.

In yet another example embodiment, a working assembly of an outdoor power device may be provided. The working assembly may comprise a motor housing which may comprise a cylindrical body portion, a top endplate, and a bottom endplate; and a housing assembly may comprise a chassis base, an oil reservoir, and a chassis arm. The bottom endplate of the motor housing may be attached to the chassis base such that chassis base covers only the bottom endplate. Additionally or alternatively, the oil reservoir may be connected to the chassis base such that it covers only a first portion of the cylindrical body portion. In some embodiments, the chassis arm may extend over the motor housing from the oil reservoir to the chassis base such that it only covers a portion of the top endplate and a second portion of the cylindrical body portion. The first portion of the cylindrical body portion may be on the opposite side of the motor housing from the second portion of the cylindrical body portion.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

That which is claimed:

1. A working assembly of an outdoor power device comprising:

an electric motor for driving the working assembly, the motor being housed in a motor housing comprising a body portion; a bottom endplate; and a top endplate, the working assembly further comprising:

a housing assembly comprising a plurality of housing portions enclosing the motor housing in a space defined by said plurality of housing portions, wherein the plurality of housing portions combine to define a first opening and a second opening such that two opposing sides of the body portion of the motor housing are exposed in respective ones of said first and second openings so that two large portions of the motor housing are not covered by the housing, and are visible and exposed to the environment;

wherein a first portion of the top end plate is not covered by the housing and is visible and exposed to the environment and second portion of the top endplate is covered by the housing.

2. The working assembly according to claim 1, wherein said plurality of housing portions comprises a first housing portion;

a second housing portion operably coupled to the first housing portion; and a third housing portion operably coupled to the first housing portion to define said space, wherein said first, second, and third housing portions combine to define said first opening and said second opening.

3. The working assembly according to claim 1, wherein said exposed, opposing sides of the body portion are unobscured by any gratings or louvers, so as to allow an unobstructed passive cooling flow of ambient air past said exposed, opposing sides of the body portion.

4. The working assembly according to claim 1, wherein a respective total area of each of said first and second openings is more than 5% of a total outer surface area of the motor housing.

5. The working assembly according to claim 1, wherein said exposed, opposing sides of the body portion of the motor housing protrude out of said space defined by said plurality of housing portions.

6. The working assembly according to claim 1, wherein the motor housing has a substantially cylindrical shape, a mantle of the cylindrical shape defining said body portion.

7. The working assembly according to claim 1 of the outdoor power device comprising:

the motor housing comprising a cylindrical body portion, the top endplate, and the bottom endplate; and the housing assembly comprising a chassis base, an oil reservoir, and a chassis arm, wherein the bottom endplate of the motor housing is attached to the chassis base such that chassis base covers only the bottom endplate, wherein the oil reservoir is connected to the chassis base such that it covers only a first portion of the cylindrical body portion, wherein the chassis arm extends over the motor housing from the oil reservoir to the chassis base such that it only covers a portion of the top endplate and a second portion of the cylindrical body portion, and wherein the first portion and the second portion of the cylindrical body portion are on opposite sides of the motor housing.

8. A housing assembly for a working assembly of an outdoor power device, the housing assembly comprising:

a first housing portion;

a second housing portion operably coupled to the first housing portion; and a third housing portion operably coupled to the first housing portion to at least partially enclose a motor housing within the housing assembly formed by the first, second and third housing portions, wherein the motor housing comprises a body portion, a top endplate, and a bottom endplate to house an electric motor for driving the working assembly, wherein the first, second, and third housing portions combine to define a first opening and a second opening such that two opposing sides of the body portion are exposed in respective ones of the first and second openings so that two large portions of the motor housing are not covered by the housing, and are visible and exposed to the environment;

wherein a first portion of the top endplate and a second portion of the top end plate are not covered by the housing and are visible and exposed to the environment; and wherein a third portion of the top endplate is covered by the third housing portion.

9. The housing assembly according to claim 8, wherein the first housing portion comprises a chassis base that is configured to receive the motor housing such that the bottom endplate is proximate to and covered by the chassis base, but such that a majority of the bottom endplate is not in contact with the chassis base.

10. The housing assembly according to claim 9, wherein the bottom endplate of the motor housing comprises a plurality of support towers for rigidly fixing the motor housing to the chassis base.

11. The housing assembly according to claim 10, wherein an insulating gasket is interposed between the one or more support towers and the chassis base.

12. The housing assembly according to claim 8, wherein the second housing portion comprises an oil reservoir that covers a portion of the body portion without contacting the motor housing.

13. The housing assembly according to claim 8, wherein the third housing portion comprises a housing arm that extends over the motor housing such that the housing arm covers the third portion of the top endplate and a portion of the body portion of the motor housing without contacting either the top endplate or the body portion of the motor housing.

14. The housing assembly according to claim 13, wherein the housing arm extends from the first housing portion to the second housing portion and comprises a curved portion that covers and curves around a portion of an engagement between the body portion of the motor housing and the top endplate such that the housing arm defines the first opening and the second opening.

15. The housing assembly according to claim 13, wherein the housing arm is configured to receive electrical wiring.

16. The housing assembly according to claim 8, wherein a gap separates the housing assembly from the entirety of the top endplate, the entirety of the body portion, and a substantial majority of the bottom endplate.

17. The housing assembly according to claim 16, wherein the gap between the motor housing and the first, second, and third housing portions is approximately 1-3 mm.

18. The housing assembly according to claim 8, wherein the body portion comprises a plurality of radially extending cooling fins.

19. The housing assembly according to claim 8, wherein the first housing portion is proximate to and covers the bottom endplate, the second housing portion is proximate to and covers a portion of the body portion, and the third housing portion comprises a housing arm proximate to and covering a portion of the body portion and the top endplate.

20. The housing assembly according to claim 8, wherein the two opposing sides of the body portion that are exposed in respective ones of the first and second openings are formed on either side of a housing arm.

21. The housing assembly according to claim 8, wherein an entire height of the body portion is exposed in respective ones of the first and second openings.

22. An outdoor power device comprising a power assembly comprising an electric power source;

a working assembly; and a control assembly for selectively providing power from the power assembly to the electric motor of the working assembly, wherein the outdoor power device further comprising:

a working assembly comprising a housing assembly and an electric motor disposed in a motor housing, the motor housing comprising a body portion, a top endplate, and a bottom endplate;

a power assembly comprising an electric power source; and a control assembly for selectively providing power from the power assembly to the working assembly via the electric motor; and wherein the housing assembly comprises a first housing portion that is operably coupled with a second housing portion and a third housing portion to at least partially enclose the motor housing such that two opposing sides of the motor housing are exposed;

wherein the first, second, and third housing portions combine to define a first opening and a second opening such that two opposing sides of the body portion are exposed in respective ones of the first and second openings so that two large portions of the motor housing are not covered by the housing, and are visible and exposed to the environment; and wherein a first portion of the top end plate is not covered by the housing and is visible and exposed to the environment and a second portion of the top end plate is covered by the housing.

23. The outdoor power device according to claim 22, further comprising a front handle and a rear handle, wherein said front and rear handles are different separate components from the housing assembly.

24. The outdoor power device according to claim 22, wherein said power assembly and said working assembly are attached to opposite ends of a pole.

* * * * *